US010310424B2

(12) United States Patent
An et al.

(10) Patent No.: US 10,310,424 B2
(45) Date of Patent: Jun. 4, 2019

(54) FIXING DEVICE THAT ALLEVIATES A PHYSICAL LOAD ON NON-HEAT-GENERATING REGIONS OF A HEAT GENERATING LAYER OF A FIXING FILM

(71) Applicant: CANON KABUSHIKI KAISHA, Tokyo (JP)

(72) Inventors: Koji An, Tokyo (JP); Takashi Narahara, Mishima (JP); Takeshi Shinji, Yokohama (JP); Toru Imaizumi, Kawasaki (JP); Kazuhiro Doda, Yokohama (JP); Kohei Wakatsu, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/848,140

(22) Filed: Dec. 20, 2017

(65) Prior Publication Data

US 2018/0181039 A1 Jun. 28, 2018

(30) Foreign Application Priority Data

Dec. 22, 2016 (JP) ..... 2016-248967

(51) Int. Cl.
*G03G 15/20* (2006.01)

(52) U.S. Cl.
CPC ..... *G03G 15/2057* (2013.01); *G03G 15/2042* (2013.01)

(58) Field of Classification Search
CPC ..... G03G 15/2057; G03G 15/2053; G03G 15/206
See application file for complete search history.

(56) References Cited

U.S. PATENT DOCUMENTS

| | | | |
|---|---|---|---|
| 7,389,079 | B2 | 6/2008 | Narahara et al. |
| 8,331,819 | B2 | 12/2012 | Fukuzawa et al. |
| 8,725,051 | B2 | 5/2014 | Yoshida et al. |
| 8,744,296 | B2 | 6/2014 | Fukuzawa et al. |
| 8,811,872 | B2 | 8/2014 | Nakagawa et al. |
| 8,891,989 | B2 | 11/2014 | Umeda et al. |
| 8,971,744 | B2 | 3/2015 | Nihonyanagi et al. |

(Continued)

FOREIGN PATENT DOCUMENTS

| | | |
|---|---|---|
| JP | 2013-057934 A | 3/2013 |
| JP | 2013-097315 A | 5/2013 |

(Continued)

*Primary Examiner* — Sandra Brase
(74) *Attorney, Agent, or Firm* — Venable LLP

(57) ABSTRACT

A fixing device includes a cylindrical film including a heat generating layer and an electroconductive layer electrically connected with the heat generating layer. A volume resistivity of the electroconductive layer is less than a volume resistivity of the heat generating layer. The fixing device further includes an energizing member, a roller, a sliding member, and a supporting member. A thermal conductivity of the sliding member is greater than a thermal conductivity of the supporting member. A recording material on which a toner image is formed is heated while being fed through a nip. A longitudinal end of the sliding member is positioned between an inner end surface and an outer end surface of the electroconductive layer with respect to the longitudinal direction of the film.

23 Claims, 7 Drawing Sheets

(56) References Cited

U.S. PATENT DOCUMENTS

| | | | | |
|---|---|---|---|---|
| 9,182,713 | B2 | 11/2015 | Narahara et al. | |
| 9,229,388 | B2 | 1/2016 | Imaizumi et al. | |
| 9,235,172 | B2 | 1/2016 | Imaizumi et al. | |
| 9,417,576 | B2 | 8/2016 | Minamishima et al. | |
| 9,423,732 | B2 | 8/2016 | Tsunashima et al. | |
| 9,423,737 | B2 | 8/2016 | Narahara et al. | |
| 9,507,303 | B2 | 11/2016 | Imaizumi et al. | |
| 9,513,586 | B2 | 12/2016 | Narahara et al. | |
| 9,720,362 | B2 | 8/2017 | Minamishima et al. | |
| 9,740,150 | B2 | 8/2017 | Tsunashima et al. | |
| 9,829,839 | B2 | 11/2017 | Ando et al. | |
| 2010/0247169 | A1* | 9/2010 | Hayashi | G03G 15/2057 399/302 |
| 2013/0195524 | A1* | 8/2013 | Ishii | G03G 15/206 399/329 |
| 2014/0023413 | A1 | 1/2014 | Shinji et al. | |
| 2014/0308052 | A1* | 10/2014 | Narahara | G03G 15/2053 399/90 |
| 2016/0139546 | A1 | 5/2016 | Imaizumi et al. | |
| 2017/0031283 | A1 | 2/2017 | Imaizumi et al. | |
| 2017/0060052 | A1 | 3/2017 | Narahara et al. | |
| 2017/0315485 | A1 | 11/2017 | Tsunashima et al. | |
| 2017/0343929 | A1 | 11/2017 | Narahara et al. | |

FOREIGN PATENT DOCUMENTS

| | | | |
|---|---|---|---|
| JP | 2014-085538 | A | 5/2014 |
| JP | 2014-206672 | A | 10/2014 |

* cited by examiner

FIXING DEVICE THAT ALLEVIATES A PHYSICAL LOAD ON NON-HEAT-GENERATING REGIONS OF A HEAT GENERATING LAYER OF A FIXING FILM

This application claims the benefit of Japanese Patent Application No. 2016-248967 filed on Dec. 22, 2016, which is hereby incorporated by reference herein in its entirety.

FIELD OF THE INVENTION AND RELATED ART

The present invention relates to a fixing device to be mounted in an image forming apparatus, such as an electrophotographic copying machine or an electrophotographic printer.

As the fixing device mounted in the electrophotographic copying machine or printer, a fixing device of a film heat generation type using a film that generates heat by energization has been known. The fixing device of this type includes a cylindrical film including a heat generating layer generating heat by energization, an energizing member for energizing the heat generating layer, a sliding member sliding on an inner peripheral surface of the film, and a pressing roller for forming a nip between itself and the film in cooperation with the sliding member. A recording material on which an unfixed toner image is carried is heated while being fed through the nip, whereby the toner image is fixed on the recording material.

Japanese Laid-Open Patent Application 2013-97315 discloses a fixing device in which a sliding member slides on an inner peripheral surface of a film and an energizing member is contacted to either one of an outer peripheral surface and an inner peripheral surface of a heat generating layer of the film at both end portions, and in which an electroconductive layer is provided over a rotational direction of a belt on a side opposite from a side (surface) where the energizing member for energizing the heat generating layer.

In the case in which a longitudinal end of the sliding member and the heat generating layer slide with each other, however, there is a possibility that the heat generating layer is abraded (worn) and thus, heat generation non-uniformity generates.

SUMMARY OF THE INVENTION

According to an aspect of the present invention, a fixing device includes a cylindrical film including a heat generating layer that generates heat by energization, the film including an electroconductive layer electrically connected with the heat generating layer and extending along a circumferential direction of the film at a longitudinal end portion of the film, wherein a volume resistivity of the electroconductive layer is lower than a volume resistivity of the heat generating layer, an energizing member configured to energize the heat generating layer, a roller, a sliding member elongated in a longitudinal direction of the film and configured to slide on an inner surface of the film and to form a nip in cooperation with the roller so as to feed a recording material through the nip, and a supporting member configured to support the sliding member from a side opposite from a side where the sliding member contacts the film, wherein a thermal conductivity of the sliding member is higher than a thermal conductivity of the supporting member, and wherein the recording material on which a toner image is formed is heated while being fed through the nip, and wherein a longitudinal end of the sliding member is positioned between an inner end surface and an outer end surface of the electroconductive layer with respect to the longitudinal direction of the film.

According to another aspect of the present invention, a fixing device includes a cylindrical film including a heat generating layer that generates heat by energization, the film including an electroconductive layer electrically connected with the heat generating layer and extending along a circumferential direction of the film at a longitudinal end portion of the film, wherein a volume resistivity of the electroconductive layer is lower than a volume resistivity of the heat generating layer, an energizing member configured to energize the heat generating layer, a roller, a sliding member elongated in a longitudinal direction of the film and configured to slide on an inner surface of the film and to form a nip in cooperation with the roller so as to feed a recording material through the nip, and a supporting member configured to support the sliding member from a side opposite from a side where the sliding member contacts the film, wherein a thermal conductivity of the sliding member is higher than a thermal conductivity of the supporting member, wherein the recording material on which a toner image is formed is heated while being fed through the nip, and wherein a longitudinal end of the sliding member is positioned outside a longitudinal end of the film with respect to the longitudinal direction of the film.

Further features of the present invention will become apparent from the following description of exemplary embodiments with reference to the attached drawings.

BRIEF DESCRIPTION OF THE DRAWINGS

Parts (a) and (b) of FIG. 1 are schematic views showing a general structure of a fixing device in Embodiment 1 according to the present invention.

DESCRIPTION OF THE EMBODIMENTS

In the following, embodiments of the present invention will be described with reference to the drawings. The following embodiments are an example of preferred embodiments of the present invention, but the present invention is not limited to the following embodiments. It is possible to replace constitutions with various other constitutions within the scope of the concept of the present invention.

Embodiment 1

Image Forming Apparatus 111

Figure 12:
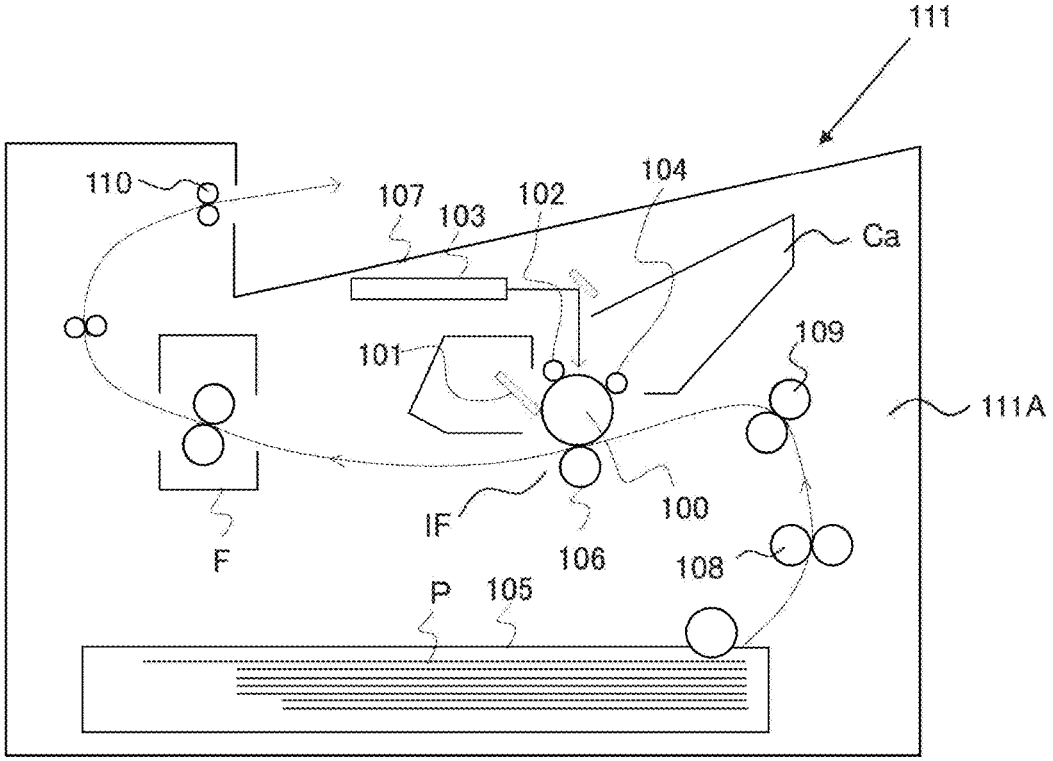
FIG. 12 is a sectional view showing a general structure of an image forming apparatus.

With reference to FIG. 12, an image forming apparatus 111 in which a fixing device F in this embodiment according to the present invention is mounted will be described. FIG. 12 is a sectional view showing a schematic structure of an example of the image forming apparatus (monochromatic laser printer in this embodiment) 111 using an electrophotographic recording technology.

In the image forming apparatus 111, an image forming portion IF for forming an image on a recording material P includes a photosensitive drum 100 as an image bearing member, a charging member 102, and a laser scanner 103. Further, the image forming portion IF includes a developing device 104, a cleaner 101 for cleaning an outer peripheral surface of the photosensitive drum 100, and a transfer member 106. An operation of the image forming portion IF is well known and, therefore, a detailed description will be omitted.

Incidentally, the photosensitive drum 100, the charging member 102, the developing device 104, and the cleaner 101 are integrally assembled into a cartridge Ca detachably mountable to an apparatus main assembly 111A.

A recording material P accommodated in a cassette 105 in the apparatus main assembly 111A is fed one by one by rotation of a roller pair 108 and then is fed by rotation of a roller pair 109 to a transfer portion formed by the photosensitive drum 100 and the transfer member 106. The recording material P on which the toner image is transferred at the transfer portion is fed to a fixing device (fixing portion) F, and the toner image is heat-fixed on the recording material P by the fixing device F. The recording material P coming out of the fixing device F is discharged onto a tray 107 by rotation of a roller 110.

Fixing Device F

The fixing device F in this embodiment is a fixing device of a film heat generation type.

Figure 1:
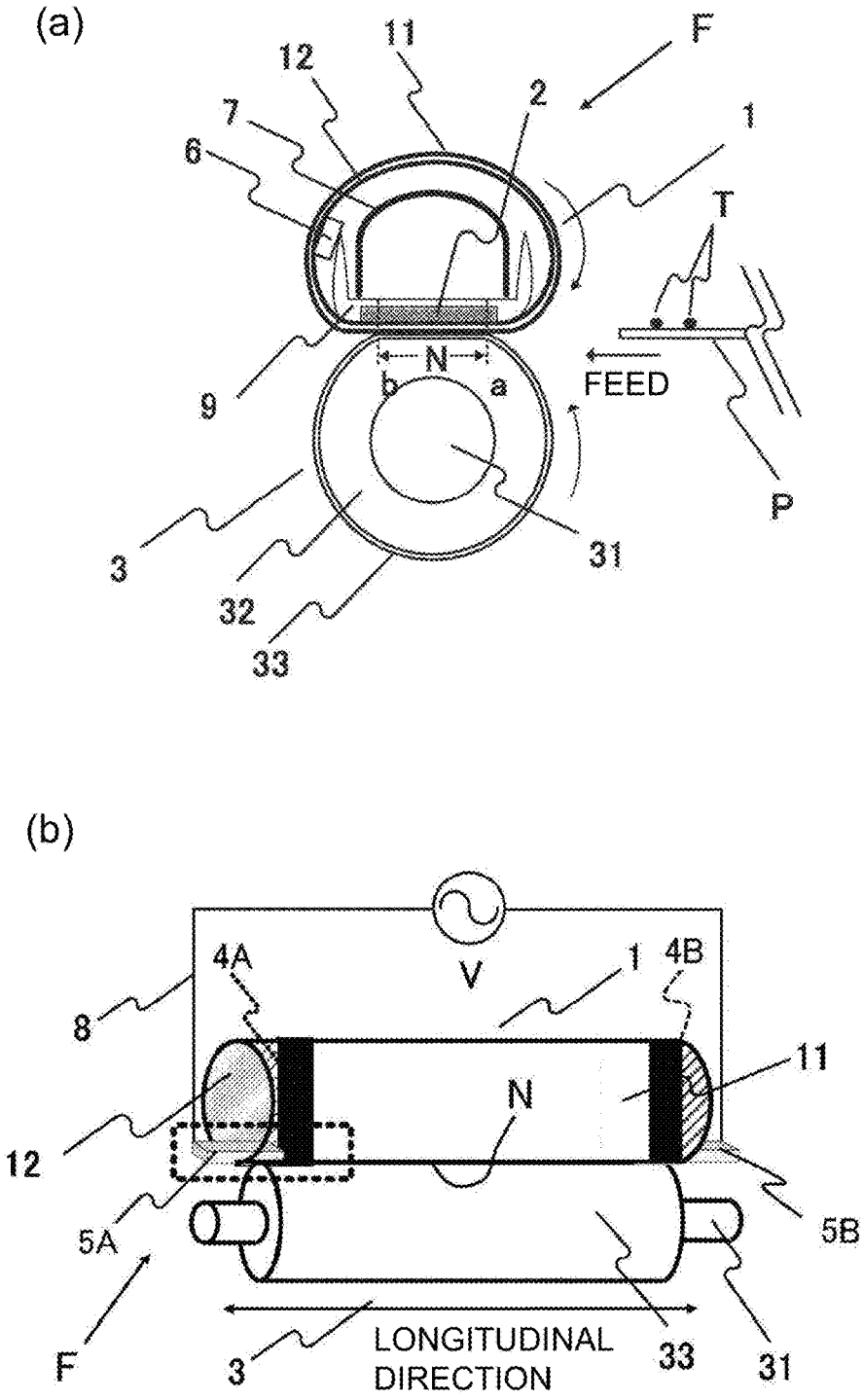
Figure 2:
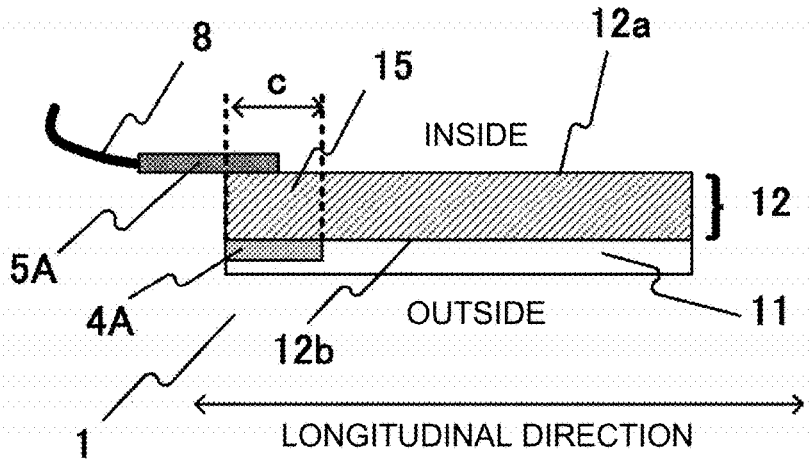
FIG. 2 is a sectional view of a film of the fixing device in Embodiment 1.
Figure 3:
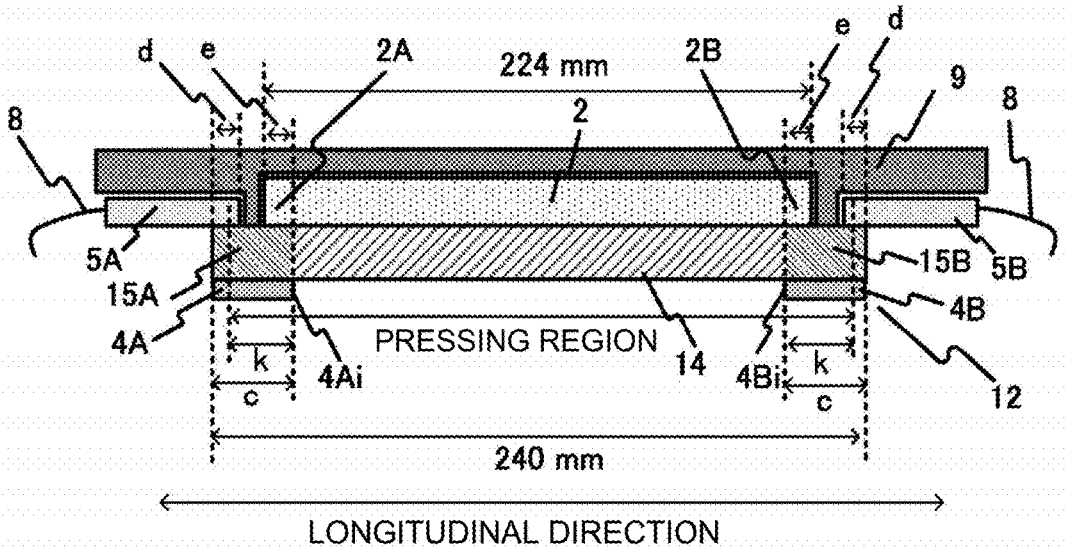
FIG. 3 is a sectional view showing a positional relationship among a heat generating layer of the film, a sliding member, a guiding member, and an energizing member of the fixing device in Embodiment 1.

Part (a) of FIG. 1 is a sectional view showing a schematic structure of the fixing device F. Part (b) of FIG. 1 is a perspective view showing the schematic structure of the fixing device F. FIG. 2 is a sectional view of a film 1 at a rectangular portion indicated by a broken line in part (b) of FIG. 1. FIG. 3 is a sectional view showing a positional relationship among a heat generating layer 12 of the film 1, a sliding member 2, a guiding member 9, and energizing members 5A and 5B.

The fixing device F includes the film 1 including the cylindrical heat generating layer 12, the energizing members 5A and 5B for energizing the heat generating layer 12, and the sliding member 2 sliding on an inner peripheral surface 12*a* of the heat generating layer 12. The fixing device F further includes the guiding member 9 inserted into a hollow portion of the heat generating layer 12, a reinforcing stay 7, and a pressing roller 3 as a pressing member for forming a nip N between itself and the film 1 in cooperation with the sliding member 2. The guiding member 9 is a member for supporting the sliding member 2 and guides rotation of the film 1. The guiding member 9 supports the sliding member 2 from a side opposite from a side (surface) where the sliding member 2 contacts the film 1. The reinforcing stay 7 is mounted on a flat surface of the guiding member 9 on a side opposite from the sliding member 2.

The film 1 has a three-layer structure, including a cylindrical heat generating layer 12, an unshown intermediary layer provided on an outer peripheral surface 12*b* of the heat generating layer 12, and a coating layer 11 coated on outer peripheral surfaces of the intermediary layer and electroconductive layers 4A and 4B. The heat generating layer 12 is a layer generating heat by energization. Further, the heat generating layer 12 is a layer having mechanical characteristics such as torsional strength and smoothness of the film 1 itself.

The heat generating layer 12 is formed by dispersing an electroconductive filler, such as carbon black, in a resin material, such as polyimide. As regards the heat generating layer 12, an electrical resistance is adjusted so that the heat generating layer 12 generates heat under application of electrical power from an AC power (voltage) source V. The intermediary layer has a function as an adhesive for bonding the coating layer 11 and the heat generating layer 12 to each other. The coating layer 11 is an outermost surface layer of the film 1, and is formed using PFA (tetrafluoroethylene-perfluoroalkylvinyl ether copolymer) or PTFE (polytetrafluoroethylene), both of which are excellent in parting property.

The pressing roller 3 includes a metal core 31 formed of iron, aluminum, or the like, an elastic layer 32 provided on an outer peripheral surface of the metal core 31 and formed of a silicone rubber, and a parting layer 33 provided on an outer peripheral surface of the elastic layer 32 and formed of PFA or the like. A hardness of a roller portion consisting of the elastic layer 32 and the parting layer 33 of the pressing roller 3 may preferably be 40 degrees to 70 degrees as measured by an Asker-C hardness meter under a load of 9.8N (1 kgf) so as to satisfy a width of the nip N, a fixing property, and a durability property. The width of the nip N is a dimension with respect to a feeding direction of the recording material P.

As regards the pressing roller 3, in this embodiment, the silicone rubber layer is formed as the elastic layer 32 in a thickness of 3.5 mm on the outer peripheral surface of the metal core 31 of iron having a diameter of 11 mm, and on the outer peripheral surface of the elastic layer 32, as the coating layer 11, a 40 μm-thick insulating PFA tube is coated. The roller portion of the pressing roller 3 is 56 degrees in hardness and 18 mm in outer diameter. With respect to a longitudinal direction perpendicular to the feeding direction of the recording material P, widths of the elastic layer 32 and the parting layer 33 are 236 mm. The metal core 31 is rotatably supported at both end portions thereof by a frame (not shown) of the fixing device F.

As shown in part (b) of FIG. 1, to the energizing members 5A and 5B, an AC cable 8 connected with the AC voltage source V is connected. The energizing members 5A and 5B electrically contact the inner peripheral surface 12*a* of the heat generating layer 12. As the energizing members 5A and 5B, a brush formed of thin wire fluxes of gold, a plate-like spring, a pad, or the like, is used.

Heat Generating Layer 12 and Electroconductive Layers 4A and 4B of Film 1

The heat generating layer 12 is formed in a cylindrical shape by the polyimide resin material. The heat generating layer 12 is 50 μm in thickness and 18 mm in diameter. With respect to the longitudinal direction perpendicular to the feeding direction of the recording material P, a width of the heat generating layer 12 is 240 mm.

In the polyimide resin material of the heat generating layer 12, carbon black is dispersed as the electroconductive filler. A thermal conductivity of the polyimide resin material of the heat generating layer 12 is 0.8 W/mK. The coating layer 11 is formed of PFA in a thickness of 15 μm.

At both end portions of the heat generating layer 12 with respect to the longitudinal direction perpendicular to the feeding direction of the recording material P, the electroconductive layers 4A and 4B are provided on the outer peripheral surface 12*b* of the heat generating layer 12 over circumferential direction of the heat generating layer 12. The electroconductive layers 4A and 4B are formed by coating a silver paste on the outer peripheral surface 12*b* of the heat generating layer 12 at both end portions of the heat generating layer 12. A width c of each of the electroconductive layers 4A and 4B is 12 mm with respect to the longitudinal direction perpendicular to the feeding direction of the recording material P.

A volume resistivity of the electroconductive layers 4A and 4B is sufficiently smaller than a volume resistivity of the heat generating layer 12. For that reason, when a voltage is applied between the electroconductive layers 4A and 4B, a current flows between the electroconductive layers 4A and 4B through the heat generating layer 12, so that a current flowing in a thickness direction of the heat generating layer 12 immediately under the heat generating layer 12 decreases. Accordingly, with respect to the longitudinal direction perpendicular to the feeding direction of the recording material P, the heat generating layer 12 generates heat in a region between the electroconductive layers 4A and 4B, so that a heat generation amount in regions immediately under the electroconductive layers 4A and 4B decreases. That is, the heat generating layer 12 can be divided into non-heat-generating regions 15A and 15B of 12 mm (=c) in width immediately under the electroconductive layers 4A and 4B, respectively, and a heat-generating region 14 of 216 mm in width.

With respect to the longitudinal direction perpendicular to the feeding direction of the recording material P, an actual resistance value between the energizing members 5A and 5B (240 mm) of the film 1 is 20Ω. With respect to the thickness direction of the film 1, an actual resistance from the energizing member 5A (5B) to the electroconductive layer 5A (5B) is 1.8Ω. This intermediary layer may have electroconductivity.

Energizing Members 5A and 5B

As the energizing members 5A and 5B, a stainless plate is used. The AC cable 8 is connected with 1 mm-thick stainless plates, and an AC voltage is applied from the AC voltage source V, whereby energization to the heat generating layer 12 is carried out. The energizing members 5A and 5B are pressed against the film 1 toward the pressing roller 3 by pressing the guiding member 9 by a pressing spring described later.

At least a part of portions (stainless plates) of the energizing members 5A and 5B contacting the heat generating layer 12 contact the heat generating layer 12 so as to overlap with the electroconductive layers 4A and 4B with respect to the longitudinal direction perpendicular to the feeding direction of the recording material P (FIG. 2). In this embodiment, with respect to the longitudinal direction perpendicular to the feeding direction of the recording material P, the part of each of the energizing members 5A and 5B is caused to enter the nip N side by 5 mm and thus, the part of each of the energizing members 5A and 5B is contacted to the heat generating layer 12.

From a contact area between the energizing member 5A (5B) and the electroconductive layer 5A (5B), the volume resistivity (electrical resistivity of the heat generating layer 12) can be calculated as follows:

$$1.8\ (\Omega)\times 25\times 10^{-6}\ (m^2)/50\ (\mu m)=0.9\ (\Omega\cdot m).$$

At this time, an electrical resistivity of the silver paste of the electroconductive layers 4A and 4B and an electrical resistivity of the stainless plate of the energizing members 5A and 5B are sufficiently small and, therefore, are disregarded. The above-described volume resistivity is set based on the assumption of the case in which the voltage of the AC voltage source is 100 V.

Sliding Member 2 and Reinforcing Stay 7

In part (a) of FIG. 1, the sliding member 2 is formed of a heat-resistant ceramic material, such as $Al_2O_3$ (alumina), AlN (aluminum nitride), MgO (magnesia), and SiC (silicon carbide), or is formed of a heat-resistant resin material, such as LCP (liquid crystal polymer), PPS (polyphenylene sulfide), or PEEK (polyether ether ketone).

The guiding member 9 supporting the sliding member 2 is formed of the heat-resistant resin material such as LCP, PPS, or PEEK.

The reinforcing stay 7 is supported at both end portions thereof by a pair of frames (not shown) of the fixing device F with respect to the longitudinal direction perpendicular to the feeding direction of the recording material P. Further, both end portions of the guiding member 9 are engaged with those of the reinforcing stay 7. Both end portions of the reinforcing stay 7 are pressed by a pressing spring (not shown) in a vertical direction perpendicular to a generatrix direction of the film 1.

The reinforcing stay 7 presses the sliding member 2 toward the inner peripheral surface (the inner peripheral surface 12*a* of the heat generating layer 12) of the film 1 via the guiding member 9 by a pressing force of the pressing spring. As a result, the elastic layer 32 of the pressing roller 3 is depressed and elastically deformed, so that the nip N is formed by the surface of the pressing roller 3 and the surface of the film 1.

The reinforcing stay 7 is prepared by using a rigid material, such as plates of iron, stainless steel, zinc-coated steel, or the like, so that the pressing force exerted on the reinforcing stay 7 at both end portions of the reinforcing stay 7 can be uniformly transmitted to the guiding member 9 and the sliding member 2 with respect to the longitudinal direction perpendicular to the feeding direction of the recording material P. Further, the reinforcing stay 7 is formed in a U-shape in cross section with respect to the feeding direction of the recording material P so that geometrical moment of inertia of the reinforcing stay 7 itself increases, whereby flexural rigidity is enhanced.

By using the rigid reinforcing stay 7 as described above, flexure of the guiding member 9 and the sliding member 2 can be suppressed, and a width (a distance between a and b shown in part (a) of FIG. 1) of the nip N with respect to the feeding direction of the recording material P is substantially uniform with respect to the longitudinal direction perpendicular to the feeding direction of the recording material P.

In this embodiment, as the sliding member 2, a 1 mm-thick alumina (thermal conductivity: 40 W/mK, volume resistivity: 12 Log Ω·m) of 8 mm in width with respect to the feeding direction of the recording material P, and 224 mm in width with respect to the longitudinal direction perpendicular to the feeding direction of the recording material P is used. That is, the volume resistivity of the sliding member 2 is higher than the volume resistivity of the heat generating layer 12. As the material of the sliding member 2, the zinc-coated steel plate is used. The pressing force (pressure) exerted on the pressing roller 3 is 160 N. At this pressing force, the width of the nip N with respect to the feeding direction of the recording material P is 6 mm.

Heat-Fixing Process Operation

A driving force of a motor (not shown) is transmitted to the metal core 31 of the pressing roller 3, whereby the pressing roller 3 is rotated in an arrow direction shown in part (a) of FIG. 1. The film 1 follows rotation of the pressing roller 3 while sliding on the sliding member 2 at the inner peripheral surface 12*a* of the heat generating layer 12, and thus rotates in the arrow direction.

When energization is carried out from the AC voltage source V to the heat generating layer 12 of the film 1 through the energizing members 5A and 5B, the heat-generating region 14 of the heat generating layer 12 generates heat, so that the film 1 abruptly increases in temperature. A temperature controller (not shown) acquires a detection temperature detected by a temperature detecting element 6 (part (a) of FIG. 1) contacted to the inner peripheral surface 12*a* of the heat generating layer 12 of the film 1, and controls an amount of energization to the heat generating layer 12 so that the detection temperature is maintained at a predetermined fixing temperature (target temperature).

The recording material P on which an unfixed toner image is carried is heated while being nipped and fed through the nip N, so that the toner image is fixed on the recording material P.

Positional Relationship Among Heat Generating Layer 12, Sliding Member 2, Guiding Member 9, and Energizing Members 5A and 5B As shown in FIG. 3, in the fixing device F in this embodiment, with respect to the longitudinal direction perpendicular to the feeding direction of the recording material P, the sliding member 2 includes both end portions 2A and 2B overlapping with the electroconductive layers 4A and 4B, respectively, at both end portions of the film 1. Both end portions 2A and 2B of the sliding member 2 are disposed outside inside end surfaces 4Ai and 4Bi, respectively, of the electroconductive layers 4A and 4B. That is, with respect to the longitudinal direction perpendicular to the feeding direction of the recording material P, on the inside of the nip N (i.e., on the inside of a pressing region of the pressing roller 3), the end portions 2A and 2B of the sliding member 2 and a part of the electroconductive layers 4A and 4B are disposed so as to overlap with each other.

In this embodiment, a width of an overlapping region e between the end portion 2A (2B) of the sliding member 2 and the electroconductive layer 4A (4B) is 4 mm, and a width of an overlapping region d between the energizing member 5A (5B) and the electroconductive layer 4A (4B) is 5 mm. In this embodiment, with respect to the longitudinal direction of the film 1, a longitudinal end of the end portion 2A (2B) of the sliding member 2 is positioned between an inside end portion (edge) and an outside end portion (edge) of the electroconductive layer 4A (4B). The thermal conductivity of the sliding member 2 is higher than the thermal conductivity of the guiding member 9. The guiding member 9 contacts the inner surface (the electroconductive layers 4A and 4B) of the film 1 on sides outside the longitudinal end portions of the sliding member 2 with respect to the longitudinal direction of the film 1.

Action

The fixing device F in this embodiment is capable of suppressing heat generation non-uniformity of the film 1. This is because, at the both end portions of the film 1, the end portions 2A and 2B of the sliding member 2 are disposed so as not to overlap with the heat-generating region 14 of the heat generating layer 12. For that reason, in the heat-generating region 14, the two members consisting of the heat generating layer 12 and the sliding member 2 form no stepped portion (no inflection point) therebetween. As a result, a degree of abrasion of the heat-generating region 14 by the end portions 2A and 2B of the sliding member 2 is alleviated, so that the heat generation non-uniformity of the film 1 is suppressed. By the above-described action, the film 1 can stably generate heat through continuous image formation.

Using a laser printer in which the fixing device F in this embodiment is mounted, in each of an N/N environment (temperature: 23° C., humidity: 50%), an L/L environment (temperature: 15° C., humidity: 10%), and an H/H environment (temperature: 30° C., humidity: 80%), 50,000 sheets of the recording material P were passed through the nip N. An input voltage was 100 V, and a supplied electrical power was 500 W. As the recording material P, paper "Xerox 4200", basis weight: 75 g/m$^2$ was used. A feeding speed of the recording material P was 120 mm/sec, and a control temperature was 200° C.

After 50,000 sheets of the recording material P were passed, when the recording material P was fed through the nip N, the surface of the film 1 was subjected to temperature measurement with a thermotracer. As a result, temperature non-uniformity of the surface of the film 1 due to the heat generation non-uniformity was suppressed to within 195±5° C., so that a good fixing image free from improper fixing and a first defect was able to be obtained.

As described above, the fixing device F in this embodiment is capable of alleviating the degree of abrasion of the heat generating layer 12 of the film 1, and, therefore, is capable of suppressing the heat generation non-uniformity of the film 1.

Modified Embodiment

As in Embodiment 1, as the material of the sliding member 2, a material having a high thermal conductivity may preferably be used. As a result, in the case in which a temperature of a non-sheet-passing region through which a large-sized recording material P passes, but a small-sized recording material P does not pass, becomes high, heat in the non-sheet-passing region is conducted to a sheet-passing region in which the temperature is relatively low, so that an effect of uniformizing the temperature non-uniformity of the film 1 with respect to the rotational direction of the film 1 is obtained.

Also, the heat supplied to the non-sheet-passing region of the small-sized recording material is transmitted (conducted) to the small-sized recording material through the sliding member 2, and, therefore, overheating of the non-sheet-passing region can be suppressed, so that even on the small-sized recording material P, the image can be fixed at an output speed equal to or somewhat slower than an output speed in the case of the large-sized recording material P.

As in this embodiment, the above-described effect can be obtained when the thermal conductivity of the sliding member 2 is higher than the thermal conductivity of the polyimide resin material that is the material of the heat generating layer 12.

Further, as in this embodiment, the sliding member 2 may preferably be formed of a material having a high volume resistivity, so that it is possible to prevent leakage of a current toward the sliding member 2 when the current flows through the heat-generating region 14 between the electroconductive layers 4A and 4B of the heat generating layer 12 of the film 1. In the case in which the sliding member 2 having a volume resistivity approximately equal to that of the heat generating layer 12 of the film 1 is used, there is a liability that the current leakage generates in the sliding member 2. Further, there is also a liability that, when a minute gap is formed between the sliding member 2 and the heat generating layer 12 due to abrasion or the like of the heat generating layer 12 of the film 1, electrical discharge generates in the minute gap.

As in this embodiment, when the volume resistivity of the sliding member 2 is higher than the volume resistivity of the heat generating layer 12, the current leakage toward the sliding member 2 is suppressed.

Further, effects of both of uniformization of the temperature non-uniformity of the heat generating layer 12 and the current leakage prevention can be obtained also by using a member (e.g., aluminum (A1050)) having a high thermal conductivity as a base material of the sliding member 2 and by subjecting a surface, of the base material, contacting the heat generating layer 12 to an insulation process. Here, the insulation process is a process such that the volume resistivity of the base material of the sliding member 2 at the surface contacting the heat generating layer 12 is higher than the volume resistivity of the heat generating layer 12. As the insulation process, oxide coating film formation using an alumite process that is an anodic oxidation process of aluminum is carried out, for example.

Figure 4:
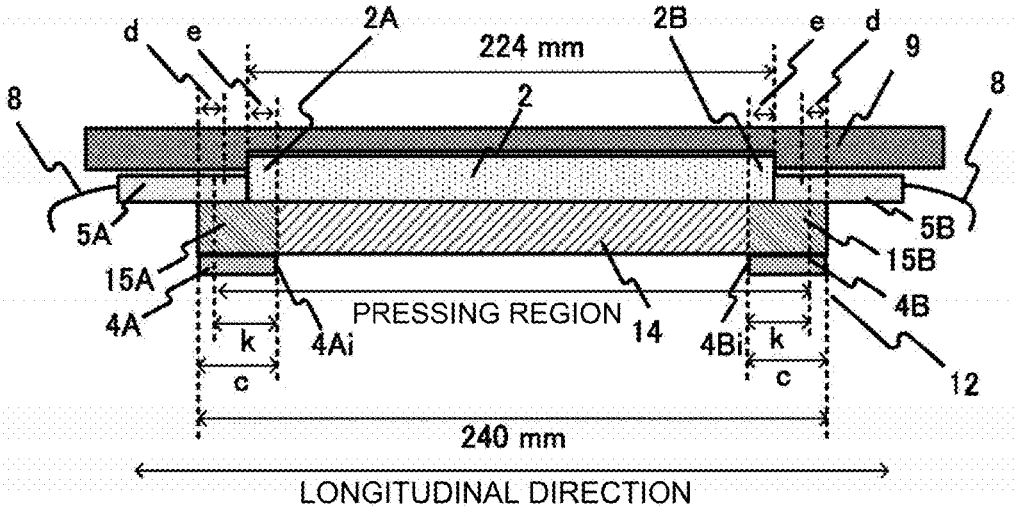
FIG. 4 is a sectional view showing a modified example of the fixing device in Embodiment 1.

FIG. 4 shows a modified embodiment of the fixing device F of Embodiment 1. FIG. 4 is a sectional view showing a positional relationship among the heat generating layer 12 of the film 1, the sliding member 2, the guiding member 9, and the energizing members 5A and 5B.

The fixing device F in the modified embodiment employs a constitution in which no guiding member 9 is interposed between the sliding member 2 and the energizing member 5A (5B) with respect to the longitudinal direction perpendicular to the feeding direction of the recording material P. That is, with respect to the longitudinal direction of the film 1, outside the longitudinal ends of the sliding member 2, the guiding member 9 does not contact the inner surfaces (electroconductive layers 4A and 4B) of the film 1. With respect to the longitudinal direction of the film 1, outside the longitudinal ends of the sliding member 2, the energizing members 5A and 5B contact the inner surfaces (electroconductive layers 4A and 4B) of the film 1. In Embodiment 1, in each of the non-heat-generating regions 15A and 15B of the heat generating layer 12, stepped portions (inflection points) of two members consisting of the sliding member 2 and the guiding member 9 are generated, but in this modified embodiment, only a stepped portion (inflection point) of the sliding member 2 is generated. For that reason, a physical load on the non-heat-generating regions 15A and 15B is alleviated.

Embodiment 2

A second embodiment of the fixing device F will be described. In this embodiment, only a constitution different from the constitution of Embodiment 1 will be described.

Figure 5:
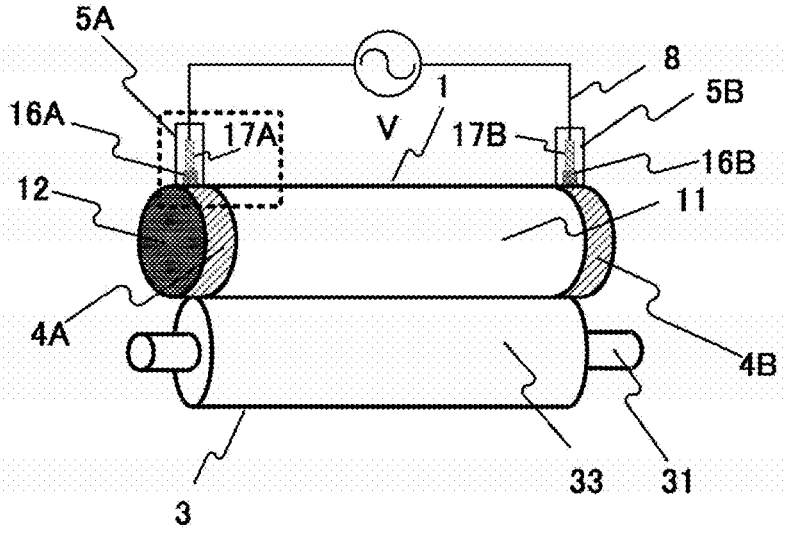
FIG. 5 is a schematic view showing a general structure of a fixing device in Embodiment 2 according to the present invention.
Figure 6:
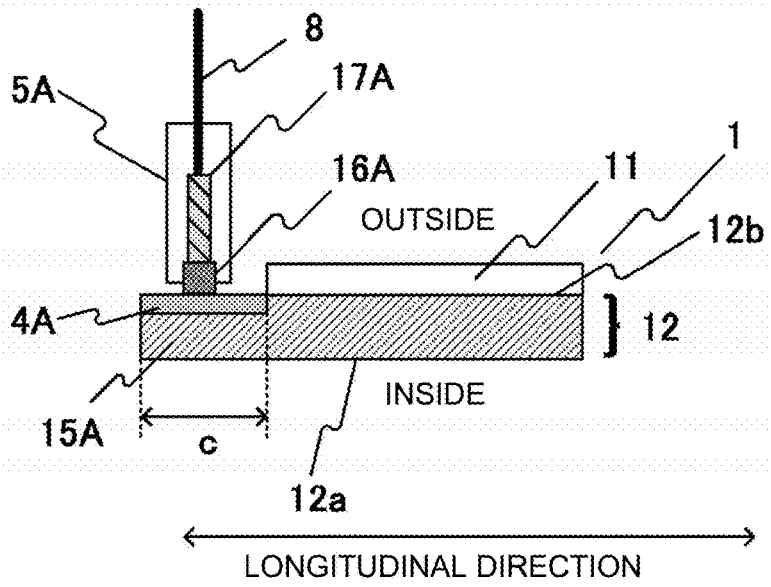
FIG. 6 is a sectional view of a film of the fixing device in Embodiment 2.
Figure 7:
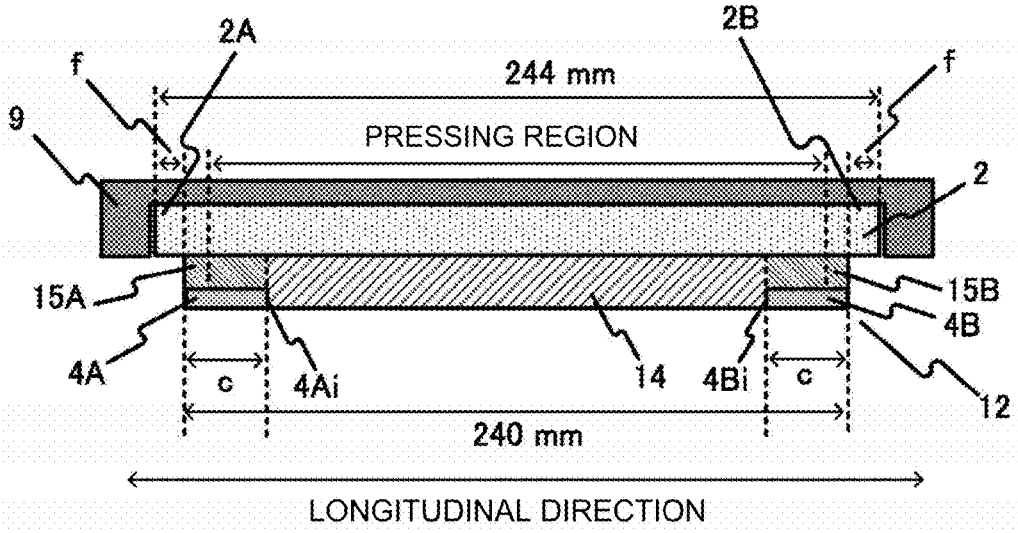
FIG. 7 is a sectional view showing a positional relationship among a heat generating layer of the film, a sliding member, and a guiding member of the fixing device in Embodiment 2.

FIG. 5 is a perspective view showing a schematic structure of the fixing device F. FIG. 6 is a sectional view of a film 1 at a rectangular portion indicated by a broken line in FIG. 5. FIG. 7 is a sectional view showing a positional relationship among a heat generating layer 12 of the film 1, a sliding member 2, and a guiding member 9.

Film 1

As regards the film 1, with respect to the longitudinal direction perpendicular to the feeding direction of the recording material P, electroconductive layers 4A and 4B formed on the outer peripheral surface 12*b* of the heat generating layer 12 at both end portions of the film 1 are exposed. As a result, the heat generating layer 12 can be energized from the outer peripheral surface of the film 1 by energizing members 5A and 5B through the electroconductive layers 4A and 4B.

In this embodiment, with respect to the longitudinal direction perpendicular to the feeding direction of the recording material P, the electroconductive layers 4A and 4B are formed by coating both end portions of the heat generating layer 12 with a silver paste over an entire region with respect to a circumferential direction of the film 1. A width c of each of the electroconductive layers 4A and 4B is 12 mm.

The volume resistivity of the electroconductive layers 4A and 4B is lower than the volume resistivity of the heat generating layer 12. Accordingly, for the same reason as that in Embodiment 1, the heat generating layer 12 is divided into non-heat-generating regions 15A and 15B, where resistive heat generation due to energization is not caused, of 12 mm (=c) in width immediately under the electroconductive layers 4A and 4B, respectively, and a heat-generating region 14, where heat generates by resistance, of 216 mm in width.

Energizing Members 5A and 5B

The energizing members 5A and 5B include carbon chips 16A and 16B, respectively, and include plate-shaped springs 17A and 17B, respectively, of stainless steel. The carbon chips 16A and 16B are pressed against the electroconductive layers 4A and 4B, respectively, by pressing forces of the springs 17A and 17B, respectively. As each of the carbon chips 16A and 16B, a carbon chip of 5 mm in width (length) with respect to each of the feeding direction of the recording material P and the longitudinal direction perpendicular to the feeding direction of the recording material P is used.

From a contact area between the energizing member 5A (5B) and the electroconductive layer 4A (4B), the volume resistivity (electrical resistivity of the heat generating layer 12) is:

$$=1.8\ (\Omega)\times 25\times 10^{-6}\ (m^2)/50\ (\mu m)=0.9\ (\Omega\cdot m).$$

At this time, an electrical resistivity of the silver paste of the electroconductive layers 4A and 4B, an electrical resistivity of the carbon chips 16A and 16B of the energizing members 5A and 5B, and an electrical resistivity of the plate-shaped stainless steel springs 17A and 17B are sufficiently small and, therefore, are disregarded.

Positional Relationship Among Heat Generating Layer 12, Sliding Member 2 and Guiding Member 9

As shown in FIG. 7, in the fixing device F in this embodiment, with respect to the longitudinal direction perpendicular to the feeding direction of the recording material P, the sliding member 2 includes both end portions 2A and 2B that do not contact the heat generating layer 12 of the film 1 on sides outside the heat generating layer 12. Both end portions 2A and 2B of the sliding member 2 are disposed outside inside end surfaces 4Ai and 4Bi, respectively, of the electroconductive layers 4A and 4B provided at both end portions of the film 1. That is, with respect to the longitudinal direction perpendicular to the feeding direction of the recording material P, on the outsides of the nip N (i.e., on the outsides of a pressing region of the pressing roller 3), both end portions 2A and 2B of the sliding member 2 and a part of the heat generating layer 12 (non-heat-generating regions 15A and 15B) are disposed.

In this embodiment, a width of a region fin which the end portion 2A (2B) of the sliding member 2 does not contact the heat generating layer 12 of the film 1 is 2 mm.

Action

The fixing device F in this embodiment is capable of suppressing heat generation non-uniformity of the heat generating layer 12. The reason therefor is as follows. Both end portions 2A and 2B of the sliding member 2 are disposed outside the nip N with respect to the longitudinal direction perpendicular to the feeding direction of the recording material P, and, therefore, in the nip N, the two members consisting of the heat generating layer 12 and the sliding member 2 form no stepped portion (no inflection point) therebetween. As a result, a degree of abrasion of the heat-generating region 14 by both end portions 2A and 2B of the sliding member 2, which are non-contact portions between the heat generating layer 12 and the sliding member 2, is alleviated, so that the heat generation non-uniformity of the film 1 is suppressed. By the above-described action, the film 1 can stably generate heat through continuous image formation.

Further, in this embodiment, no stepped portion (no inflection point) is formed between the sliding member 2 and the heat generating layer 12 in each of the non-heat-generating regions 15A and 15B, and, therefore, also a degree of abrasion in the non-heat-generating regions 15A and 15B by both end portions 2A and 2B of the sliding member 2 can be suppressed, so that also an effect of improving durability of the fixing device F itself is achieved.

Using a laser printer in which the fixing device F in this embodiment is mounted, in each of an N/N environment (temperature: 23° C., humidity: 50%), an L/L environment (temperature: 15° C., humidity: 10%), and an H/H environment (temperature: 30° C., humidity: 80%), 100,000 sheets of the recording material P were passed through the nip N. An input voltage was 100 V, and a supplied electrical power was 500 W. As the recording material P, paper "Xerox 4200", basis weight: 75 g/m$^2$ was used. A feeding speed of the recording material P was 120 mm/sec, and a control temperature was 200° C.

After 100,000 sheets of the recording material P were passed, when the recording material P was fed through the nip N, the surface of the film 1 was subjected to temperature measurement with a thermotracer. As a result, temperature non-uniformity of the surface of the film 1 due to the heat generation non-uniformity was suppressed to within 195±5° C., so that a good fixing image free from improper fixing and a first defect was able to be obtained.

Confirmation of Effect of Fixing Device F in Embodiment 2

An effect of the fixing device F in this embodiment was confirmed by comparison with a fixing device in a comparison example.

The fixing device in the comparison example will be described with reference to FIG. 8.

Figure 8:
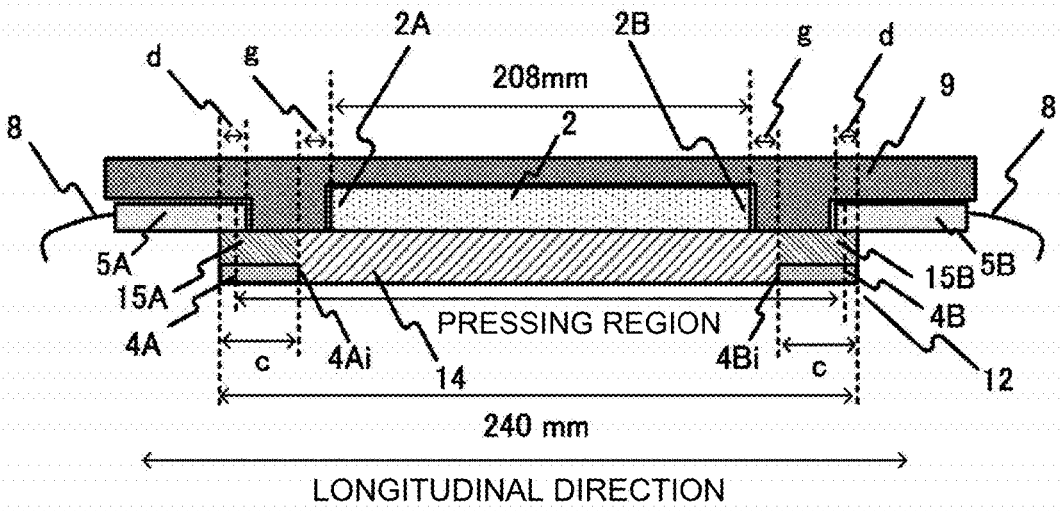
FIG. 8 is a sectional view of a fixing device in a Comparison Example 1.

FIG. 8 is a sectional view showing a positional relationship among the heat generating layer 12 of the film 1, the sliding member 2, and the guiding member 9.

Similarly, as in Embodiment 1, as the sliding member 2, a 1 mm-thick alumina plate (thermal conductivity: 40 W/mK, surface resistance: 12 Log Ω·m) of 8 mm in width with respect to the feeding direction of the recording material P, and 216 mm in width with respect to the longitudinal direction perpendicular to the feeding direction of the recording material P is used. In the comparison example, as in the constitution of Embodiment 1, the width of the sliding member 2 with respect to the longitudinal direction perpendicular to the feeding direction of the recording material P is shorter than a width of the heat-generating region 14. For that reason, with respect to the longitudinal direction perpendicular to the feeding direction of the recording material P, the end portions 2A and 2B of the sliding member 2 slide on the heat generating layer 12 in the heat-generating region 14.

Further, with respect to the longitudinal direction perpendicular to the feeding direction of the recording material P, a region g from the end portion 2A (2B) of the sliding member 2 to an end of the heat-generating region 14 is 4 mm. An overlapping region d between the energizing member 5A (5B) and the electroconductive layer 4A (4B) is 5 mm. In the comparison example, with respect to the longitudinal direction perpendicular to the feeding direction of the recording material P, a part of the energizing member 5A (5B) is caused to enter the nip N (the pressing region of the pressing roller 3) by 5 mm and thus, is contacted to the heat generating layer 12.

Using a laser printer in which the fixing device F in this embodiment is mounted and a laser printer in which the fixing device in the comparison example is mounted in the L/L environment (temperature: 15° C., humidity: 10%), 100,000 sheets of the recording material P were passed through the nip N. An input voltage was 100 V, and a supplied electrical power was 500 W. As the recording material P, paper "Xerox 4200", basis weight: 75 g/m$^2$ was used. A feeding speed of the recording material P was 120 mm/sec, and a control temperature was 200° C.

After 100,000 sheets of the recording material P were passed, when the recording material P was fed through the nip N, the surface of the film 1 was subjected to temperature measurement with a thermotracer.

An evaluation result of heat generation non-uniformity and an image quality in this embodiment (Embodiment 2) and the comparison example after passing of 100,000 sheets is shown in Table 1. In Table 1, "o" shows no generation of the first defect, and "x" shows generation of the image defect due to the heat generation non-uniformity.

TABLE 1

| Constitution | HGN*[1] | Image |
|---|---|---|
| EMB. 2 | 195 ± 5° C. | o |
| COMP. EX. | 195 ± 12° C. | x |

*[1]"HGN" is the heat generation non-uniformity.

As shown in Table 1, in the comparison example, both end portions 2A and 2B of the sliding member 2 slid on the heat generating layer 12 in the heat-generating region 14, and thus, the heat generating layer 12 abraded in the heat-generating region 14 and the temperature non-uniformity increased by ±12° C., with the result that improper fixing generated also in image quality evaluation.

On the other hand, in Embodiment 2, although the heat generation non-uniformity generated, the degree of the heat generation non-uniformity is ±5° C., i.e., smaller than ±12° C. in the comparison example, so that a good image was obtained.

As described above, the fixing device F in this embodiment is capable of alleviating the degree of abrasion of the heat generating layer 12 of the film 1, and, therefore, is capable of suppressing the heat generation non-uniformity of the film 1.

Embodiment 3

A third embodiment of the fixing device F will be described. In this embodiment, only a constitution different from the constitution of Embodiment 1 will be described.

Figure 9:
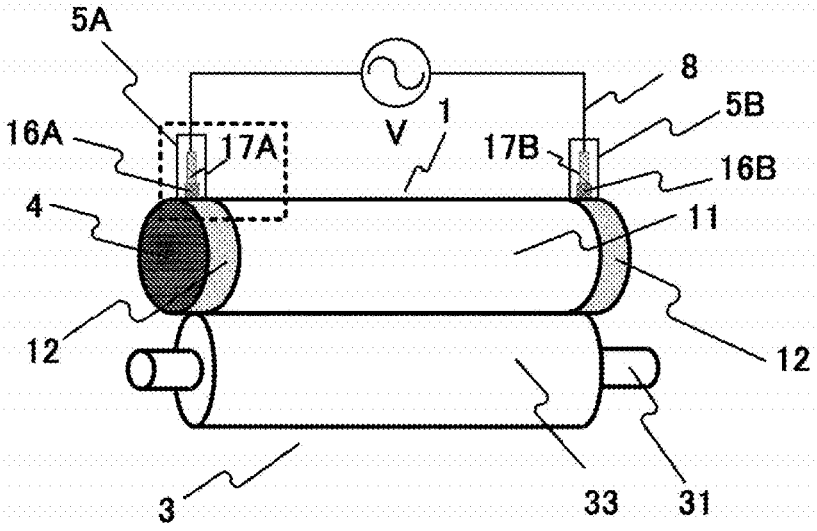
FIG. 9 is a schematic view showing a general structure of a fixing device in Embodiment 3 according to the present invention.
Figure 10:
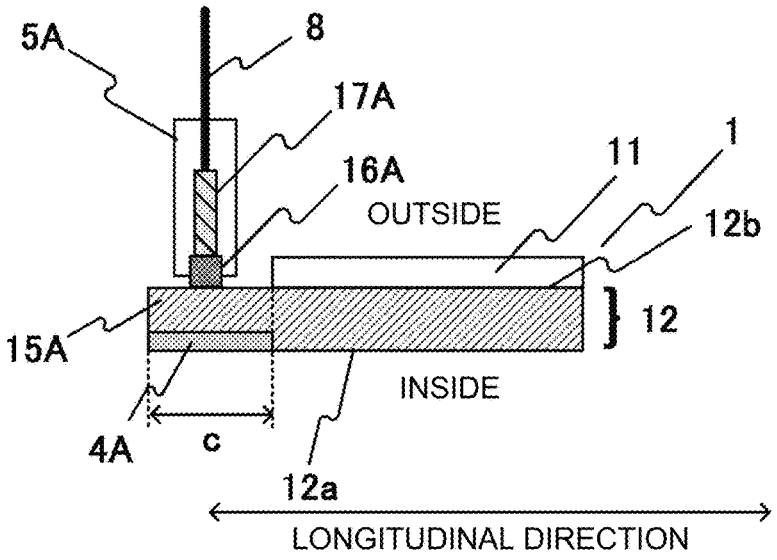
FIG. 10 is a sectional view of a film of the fixing device in Embodiment 3.
Figure 11:
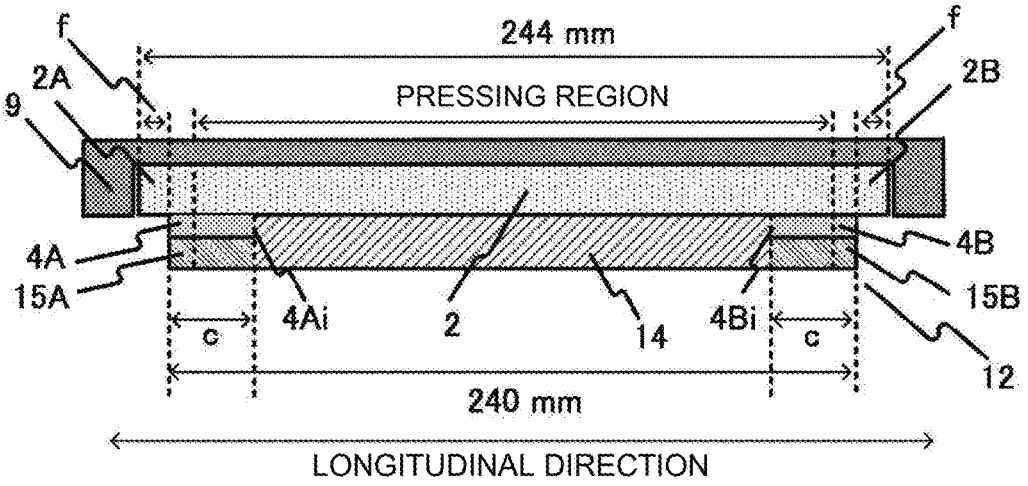
FIG. 11 is a sectional view showing a positional relationship among a heat generating layer of the film, a sliding member, and a guiding member of the fixing device in Embodiment 3.

FIG. 9 is a perspective view showing a schematic structure of the fixing device F. FIG. 10 is a sectional view of a film 1 at a rectangular portion indicated by a broken line in FIG. 9. FIG. 11 is a sectional view showing a positional relationship among a heat generating layer 12 of the film 1, a sliding member 2, and a guiding member 9.

Film 1

The fixing device F in this embodiment has a constitution in which positions of formation of the electroconductive layers 4A and 4B of the film 1 in Embodiment 2 are changed. That is, with respect to the longitudinal direction perpendicular to the feeding direction of the recording material P, the electroconductive layers 4A and 4B are formed on an inner peripheral surface 12*a* of the heat generating layer 12 at both end portions of the heat generating layer 12 of the film 1. An intermediary layer (not shown) and a coating layer 11 are not formed on an outer peripheral surface of the heat generating layer 12 of the film 1 at both end portions of the heat generating layer 12, and by the energizing members 5A and 5B, the electroconductive layers 4A and 4B can be energized through the heat generating layer 12.

In this embodiment, with respect to the longitudinal direction perpendicular to the feeding direction of the recording material P, the electroconductive layers 4A and 4B are formed by coating the inner peripheral surface of both end portions of the heat generating layer 12 with a silver paste over an entire region with respect to a circumferential direction of the film 1. A width c of each of the electroconductive layers 4A and 4B is 12 mm. The volume resistivity of the electroconductive layers 4A and 4B is lower than the volume resistivity of the heat generating layer 12. Accordingly, for the same reason as that in Embodiment 1, the heat generating layer 12 is divided into non-heat-generating regions 15A and 15B, where resistive heat generation due to energization is not caused, of 12 mm (=c) in width immediately on the electroconductive layers 4A and 4B, respectively, and a heat-generating region 14, where heat generates by resistance, of 216 mm in width.

With respect to the longitudinal direction perpendicular to the feeding direction of the recording material P, an actual resistance value of the film 1 between the energizing members 5A and 5B (240 mm) is 20Ω. With respect to the thickness direction of the film 1, an actual resistance value from the energizing member 5A (5B) to the electroconductive layer 4A (4B) is 1.8Ω. The intermediary layer may also have electroconductivity.

Positional Relationship Among Heat Generating Layer 12, Sliding Member 2 and Guiding Member 9

As shown in FIG. 11, in the fixing device F in this embodiment, with respect to the longitudinal direction perpendicular to the feeding direction of the recording material P, the sliding member 2 includes both end portions 2A and 2B that do not contact the heat generating layer 12 of the film 1 on sides outside the heat generating layer 12. Both end portions 2A and 2B of the sliding member 2 are disposed outside inside end surfaces 4Ai and 4Bi, respectively, of the electroconductive layers 4A and 4B provided at both end portions of the film 1. That is, with respect to the longitudinal direction perpendicular to the feeding direction of the recording material P, on the outsides of the nip N (i.e., on the outsides of a pressing region of the pressing roller 3), both end portions 2A and 2B of the sliding member 2 and a part of the heat generating layer 12 (non-heat-generating regions 15A and 15B) are disposed.

In this embodiment, a width of a region fin which the end portion 2A (2B) of the sliding member 2 does not contact the electroconductive layers 4A and 4B of the film 1 is 2 mm.

Action

The fixing device F in this embodiment is also capable of suppressing heat generation non-uniformity of the heat generating layer 12. The reason therefor is as follows. Both end portions 2A and 2B of the sliding member 2 are disposed outside the nip N with respect to the longitudinal direction perpendicular to the feeding direction of the recording material P, and, therefore, in the nip N, the two members consisting of the heat generating layer 12 and the sliding member 2 form no stepped portion (no inflection point) therebetween. As a result, a degree of abrasion of the heat-generating region 14 by both end portions 2A and 2B of the sliding member 2, which are non-contact portions between the heat generating layer 12 and the sliding member 2, is alleviated, so that the heat generation non-uniformity of the film 1 is suppressed. By the above-described action, the film 1 can stably generate heat through continuous image formation.

Further, also in this embodiment, no stepped portion (no inflection point) is formed between the sliding member 2 and the heat generating layer 12 in each of the non-heat-generating regions 15A and 15B, and, therefore, also a degree of abrasion in the non-heat-generating regions 15A and 15B by the both end portions 2A and 2B of the sliding member 2 can be suppressed, so that also an effect of improving durability of the fixing device F itself is achieved.

Further, in this embodiment, the energizing members 5A and 5B are prevented from contacting the electroconductive layers 4A and 4B, and, therefore, the degree of abrasion of the electroconductive 4A and 4B themselves is alleviated and leads to further extension of the lifetime of the fixing device F.

Using a laser printer in which the fixing device F in this embodiment is mounted, in each of an N/N environment (temperature: 23° C., humidity: 50%), an L/L environment (temperature: 15° C., humidity: 10%), and an H/H environment (temperature: 30° C., humidity: 80%), 100,000 sheets of the recording material P were passed through the nip N. An input voltage was 100 V, and a supplied electrical power was 500 W. As the recording material P, paper "Xerox 4200", basis weight: 75 g/m$^2$ was used. A feeding speed of the recording material P was 120 mm/sec, and a control temperature was 200° C.

After 100,000 sheets of the recording material P were passed, when the recording material P was fed through the nip N, the surface of the film 1 was subjected to temperature measurement with a thermotracer. As a result, temperature non-uniformity of the surface of the film 1 due to the heat generation non-uniformity was suppressed to within 195±5° C., so that a good fixing image free from improper fixing and a first defect was able to be obtained.

Further, even after 100,000 sheets of the recording material P were passed, it was confirmed that both of temperature non-uniformity and an image (quality) were unchanged from initial performances.

As described above, the fixing device F in this embodiment is capable of alleviating the degree of heat generation non-uniformity of the heat generating layer 12 of the film 1, and, therefore, is capable of suppressing the heat generation non-uniformity of the film 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

(A) a cylindrical film including a heat generating layer that generates heat by energization, and an electroconductive layer electrically connected with the heat generating layer and extending along a circumferential direction of the film at a longitudinal end portion of the film, wherein a volume resistivity of the electroconductive layer is less than a volume resistivity of the heat generating layer;

(B) an energizing member configured to energize the heat generating layer;

(C) a roller;

(D) a sliding member elongated in a longitudinal direction of the film and configured to slide on an inner surface of the film and to form a nip in cooperation with the roller, so as to feed a recording material through the nip; and (E) a supporting member configured to support the sliding member from a side opposite from a side on which the sliding member contacts the film, wherein a thermal conductivity of the sliding member is greater than a thermal conductivity of the supporting member, wherein the recording material, on which a toner image is formed is heated while being fed through the nip, and wherein a longitudinal end of the sliding member is positioned between an inner end surface and an outer end surface of the electroconductive layer with respect to the longitudinal direction of the film.

2. The fixing device according to claim 1, wherein the thermal conductivity of the sliding member is greater than a thermal conductivity of the heat generating layer.

3. The fixing device according to claim 1, wherein the supporting member contacts the inner surface of the film at a position outside of the longitudinal end of the sliding member with respect to the longitudinal direction of the film.

4. The fixing device according to claim 1, wherein the energizing member contacts the inner surface of the film at a position outside of the longitudinal end of the sliding member with respect to the longitudinal direction of the film.

5. The fixing device according to claim 1, wherein a volume resistivity of the sliding member is greater than the volume resistivity of the heat generating layer.

6. The fixing device according to claim 1, wherein the electroconductive layer is overlapped on the heat generating layer at the longitudinal end portion of the film.

7. The fixing device according to claim 6, wherein the electroconductive layer is provided on an outer surface of the heat generating layer, and wherein the energizing member contacts the inner surface of the film.

8. The fixing device according to claim 1, wherein the heat generating layer is formed of a polyimide material in which an electroconductive filler is dispersed.

9. A fixing device comprising:

(A) a cylindrical film including a heat generating layer that generates heat by energization, and an electroconductive layer electrically connected with the heat generating layer and extending along a circumferential direction of the film at a longitudinal end portion of the film, wherein a volume resistivity of the electroconductive layer is less than a volume resistivity of the heat generating layer;

(B) an energizing member configured to energize the heat generating layer;

(C) a roller;

(D) a sliding member elongated in a longitudinal direction of the film and configured to slide on an inner surface of the film and to form a nip in cooperation with the roller, so as to feed a recording material through the nip, a longitudinal end of the sliding member being positioned outside of a longitudinal end of the film with respect to the longitudinal direction of the film, and the sliding member being formed of a material that is one of a ceramic and an insulation coated metal; and (E) a supporting member configured to support the sliding member from a side opposite from a side on which the sliding member contacts the film, wherein a thermal conductivity of the sliding member is greater than a thermal conductivity of the supporting member, wherein the recording material, on which a toner image is formed, is heated while being fed through the nip.

10. The fixing device according to claim 9, wherein the electroconductive layer is overlapped on the heat generating layer at the longitudinal end portion of the film.

11. The fixing device according to claim 10, wherein the electroconductive layer is provided on an outer surface of the heat generating layer, and wherein the energizing member contacts an outer surface of the film.

12. The fixing device according to claim 10, wherein the heat generating layer is formed of a polyimide material in which an electroconductive filler is dispersed.

13. A fixing device comprising:

(A) a cylindrical film including a heat generating layer that generates heat by energization, and an electroconductive layer electrically connected with the heat generating layer and extending along a circumferential direction of the film at a longitudinal end portion of the film, wherein a volume resistivity of the electroconductive layer is less than a volume resistivity of the heat generating layer;

(B) an energizing member configured to energize the heat generating layer;

(C) a roller being in contact with an outer surface of the film;

(D) a nip forming member being in contact with an inner surface of the film and elongated in a longitudinal direction of the film, the nip forming member forming a nip in cooperation with the roller, so as to feed a recording material through the nip, a longitudinal end of the nip forming member being positioned outside of a longitudinal end of the film with respect to the longitudinal direction of the film, and the nip forming member being formed of a material that is one of a ceramic and an insulation coated metal; and (E) a supporting member configured to support the nip forming member from a side opposite from a side on which the nip forming member contacts the film, wherein a thermal conductivity of the nip forming member is greater than a thermal conductivity of the supporting member, wherein the recording material on which a toner image is formed is heated while being fed through the nip.

14. The fixing device according to claim 13, wherein the thermal conductivity of the nip forming member is greater than a thermal conductivity of the heat generating layer.

15. The fixing device according to claim 13, wherein the electroconductive layer is overlapped on the heat generating layer at the longitudinal end portion of the film.

16. The fixing device according to claim 15, wherein the electroconductive layer is provided on an outer surface of the heat generating layer, and wherein the energizing member contacts the outer surface of the film.

17. The fixing device according to claim 13, wherein the heat generating layer is formed of a polyimide material in which an electroconductive filler is dispersed.

18. A fixing device comprising:

(A) a cylindrical film including a heat generating layer that generates heat by energization, and an electroconductive layer electrically connected with the heat generating layer and extending along a circumferential direction of the film at a longitudinal end portion of the film, wherein a volume resistivity of the electroconductive layer is less than a volume resistivity of the heat generating layer;

(B) an energizing member configured to energize the heat generating layer;

(C) a roller being in contact with an outer surface of the film;

(D) a nip forming member being in contact with an inner surface of the film and elongated in a longitudinal direction of the film, the nip forming member forming a nip in cooperation with the roller, so as to feed a recording material through the nip, and a longitudinal end of the sliding member being positioned between an inner end and an outer end of the electroconductive layer with respect to the longitudinal direction of the film; and (E) a supporting member configured to support the nip forming member from a side opposite from a side on which the nip forming member contacts the film, wherein a thermal conductivity of the nip forming member is greater than a thermal conductivity of the supporting member, wherein the recording material, on which a toner image is formed, is heated while being fed through the nip.

19. The fixing device according to claim 18, wherein the nip forming member is formed of a material that is one of a ceramic and an insulation coated metal.

20. The fixing device according to claim 18, wherein the thermal conductivity of the nip forming member is greater than a thermal conductivity of the heat generating layer.

21. The fixing device according to claim 18, wherein the electroconductive layer is overlapped on the heat generating layer at the longitudinal end portion of the film.

22. The fixing device according to claim 21, wherein the electroconductive layer is provided on an outer surface of the heat generating layer, and wherein the energizing member contacts the outer surface of the film.

23. The fixing device according to claim 18, wherein the heat generating layer is formed of a polyimide material in which an electroconductive filler is dispersed.

* * * * *